US007195448B2

(12) United States Patent
Levine et al.

(10) Patent No.: US 7,195,448 B2
(45) Date of Patent: Mar. 27, 2007

(54) COOLED ROTOR BLADE

(75) Inventors: Jeffrey R. Levine, Wallingford, CT (US); Edward Pietraszkiewicz, Southington, CT (US); John Calderbank, Glastonbury, CT (US); Dominic J. Mongillo, Jr., West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 105 days.

(21) Appl. No.: 10/855,188

(22) Filed: May 27, 2004

(65) Prior Publication Data

US 2005/0265844 A1 Dec. 1, 2005

(51) Int. Cl.
*F01D 5/18* (2006.01)

(52) U.S. Cl. ..... 415/115; 416/96 R; 416/97 R

(58) Field of Classification Search ..... 415/115, 415/116, 96 R, 97 R, 90 R; 416/96 R, 97 R, 416/90 R See application file for complete search history.

(56) References Cited

U.S. PATENT DOCUMENTS 4,514,144 A * 4/1985 Lee ..... 416/96 R
5,558,497 A 9/1996 Kraft et al.
5,820,343 A 10/1998 Kraft et al.
6,139,269 A * 10/2000 Liang ..... 416/97 R
6,402,470 B1 6/2002 Kvasnak et al.

* cited by examiner

*Primary Examiner*—Edward K. Look
*Assistant Examiner*—Dwayne J White
(74) *Attorney, Agent, or Firm*—Colin L. Cini

(57) ABSTRACT

A rotor blade is provided that includes a root, a hollow airfoil, and a conduit disposed within the root. The hollow airfoil has a cavity defined by a suction side wall, a pressure side wall, a leading edge, a trailing edge, a base, and a tip. An internal passage configuration is disposed within the cavity. The configuration includes a first radial passage, a second radial passage, a rib disposed between and separating the first radial passage and second radial passage, a plurality of crossover apertures disposed within the rib, and a plurality of trip strips disposed within the second radial passage. The trip strips are attached to an interior surface of one or both of the pressure side wall and the suction side wall. The trip strips are disposed within the first radial passage at an angle α that is skewed relative to a cooling airflow direction within the first radial passage, and positioned such that each of the plurality of trip strips converges toward the rib. The rib end of at least a portion of the plurality of trip strips is located between a pair of adjacent crossover apertures. The conduit is operable to permit airflow through the root and into the first passage.

10 Claims, 2 Drawing Sheets

COOLED ROTOR BLADE

BACKGROUND OF THE INVENTION

1. Technical Field

This invention applies to gas turbine rotor blades in general, and to cooled gas turbine rotor blades in particular.

2. Background Information

Turbine sections within an axial flow turbine engine include rotor assemblies that include a rotating disc and a number of rotor blades circumferentially disposed around the disk. Rotor blades include an airfoil portion for positioning within the gas path through the engine. Because the temperature within the gas path very often negatively affects the durability of the airfoil, it is known to cool an airfoil by passing cooling air through the airfoil. The cooled air helps decrease the temperature of the airfoil material and thereby increase its durability.

Prior art cooled rotor blades very often utilize internal passage configurations that include a first radial passage extending contiguous with the leading edge, a second radial passage, and a rib disposed between and separating the passages. A plurality of crossover apertures is disposed within the rib, typically oriented perpendicular to the airfoil wall along the leading edge. A pressure difference across the rib causes a portion of the cooling air traveling within the second radial passage to pass through the crossover apertures and impinge on the leading edge wall. Cooling air passing through the crossover apertures typically travels in a direction perpendicular to the direction of the cooling airflow within the second radial passage. Hence, in the known prior art configurations cooling air is driven through the crossover apertures predominantly by static pressure, without little or no dynamic pressure contribution. Impingement cooling is efficient and desirable, but is provided in the prior art at the cost of a substantial static pressure drop across the rib.

The external gas path pressure is highest at the leading edge region during operation of the blade. In many turbine applications, airfoils are typically backflow margin limited at the leading edge of the airfoil. "Backflow margin" refers to the ratio of internal pressure to external pressure. To ensure an undesirable flow of hot gases from the gaspath does not flow into an airfoil, it is known to maintain a particular predetermined backflow margin that accounts for expected internal and external pressure variations. Hence, it is desirable to minimize pressure drops within the airfoil to the extent possible.

In addition to impingement cooling, it is also known to use trips strips within a cavity passage to enhance heat transfer between the cooling air and the airfoil. The trip strips enhance heat transfer by inducing the flow to become turbulent. Heat transfer in a boundary layer that is characterized by turbulent flow is typically greater than it is with one characterized by laminar flow. In addition to inducing turbulent flow, trip strips also provide additional surface area through which heat transfer may take place.

It is known to implement trip strips in a passage adjacent the crossover apertures (i.e., second radial passage). In the prior art of which we are aware, there is no specific positional relationship between the trip strips and crossover apertures. In fact, very often the trip strips are positioned where they impede cooling airflow through the crossover apertures.

What is needed, therefore, is an airfoil having an internal passage configuration that promotes desirable cooling of the airfoil and thereby increases the durability of the blade.

DISCLOSURE OF THE INVENTION

According to the present invention, a rotor blade is provided that includes a root, a hollow airfoil, and a conduit disposed within the root. The hollow airfoil has a cavity defined by a suction side wall, a pressure side wall, a leading edge, a trailing edge, a base, and a tip. An internal passage configuration is disposed within the cavity. The configuration includes a first radial passage, a second radial passage, a rib disposed between and separating the first radial passage and second radial passage, a plurality of crossover apertures disposed within the rib, and a plurality of trip strips disposed within the second radial passage. The trip strips are attached to an interior surface of one or both of the pressure side wall and the suction side wall. The trip strips are disposed within the second radial passage at an angle $\alpha$ that is skewed relative to a cooling airflow direction within the second radial passage, and positioned such that each of the plurality of trip strips converges toward the rib. The rib end of at least a portion of the plurality of trip strips is located between a pair of adjacent crossover apertures. The conduit is operable to permit airflow through the root and into the first passage.

One of the advantages of the present rotor blade and method is that airflow pressure losses within the airfoil are decreased relative to prior art airfoils having impingement cooling of which we are aware.

These and other objects, features and advantages of the present invention will become apparent in light of the detailed description of the best mode embodiment thereof, as illustrated in the accompanying drawings.

DETAILED DESCRIPTION OF THE INVENTION

Figure 1:
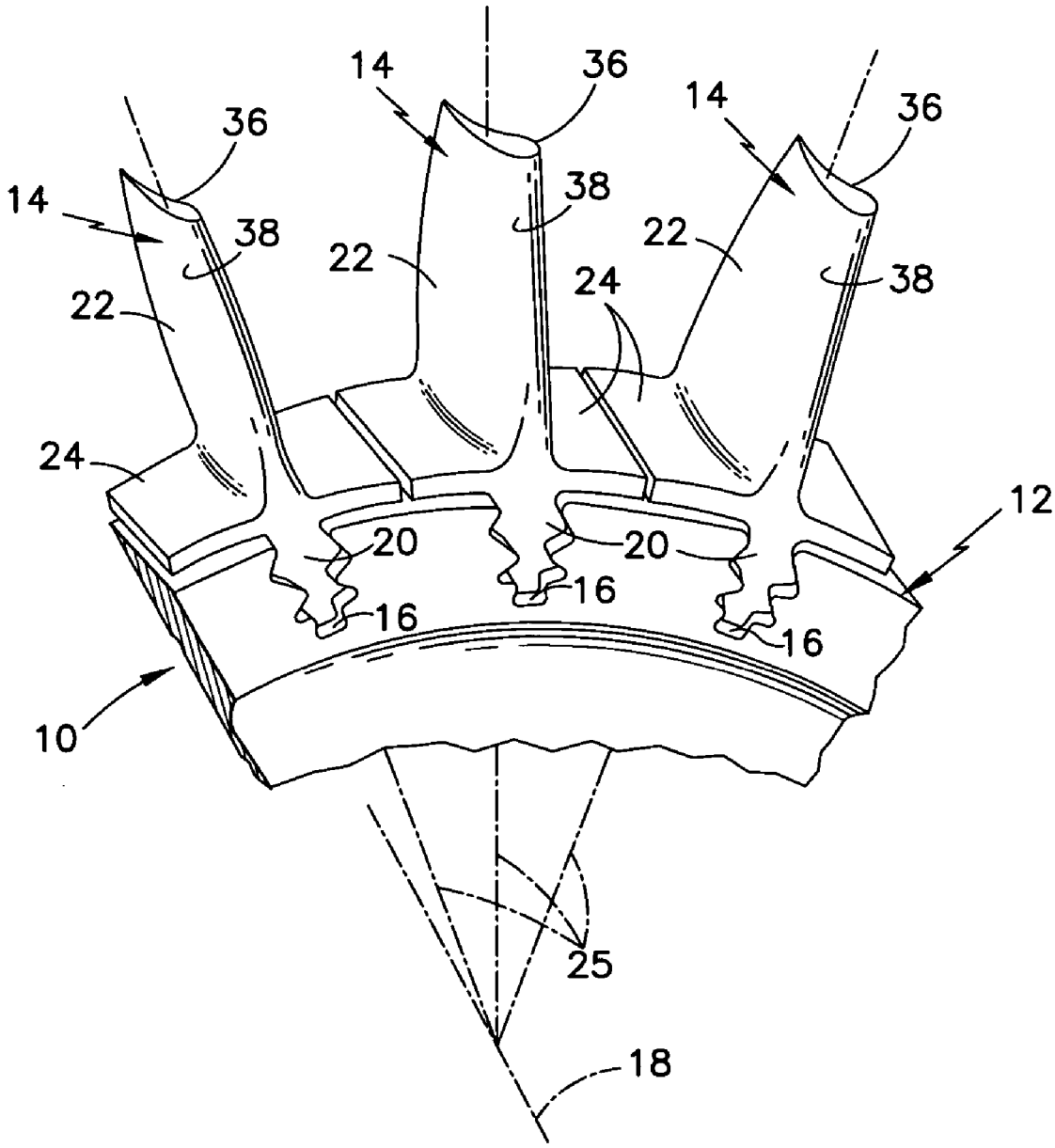
FIG. 1 is a diagrammatic perspective view of the rotor assembly section.
Figure 2:
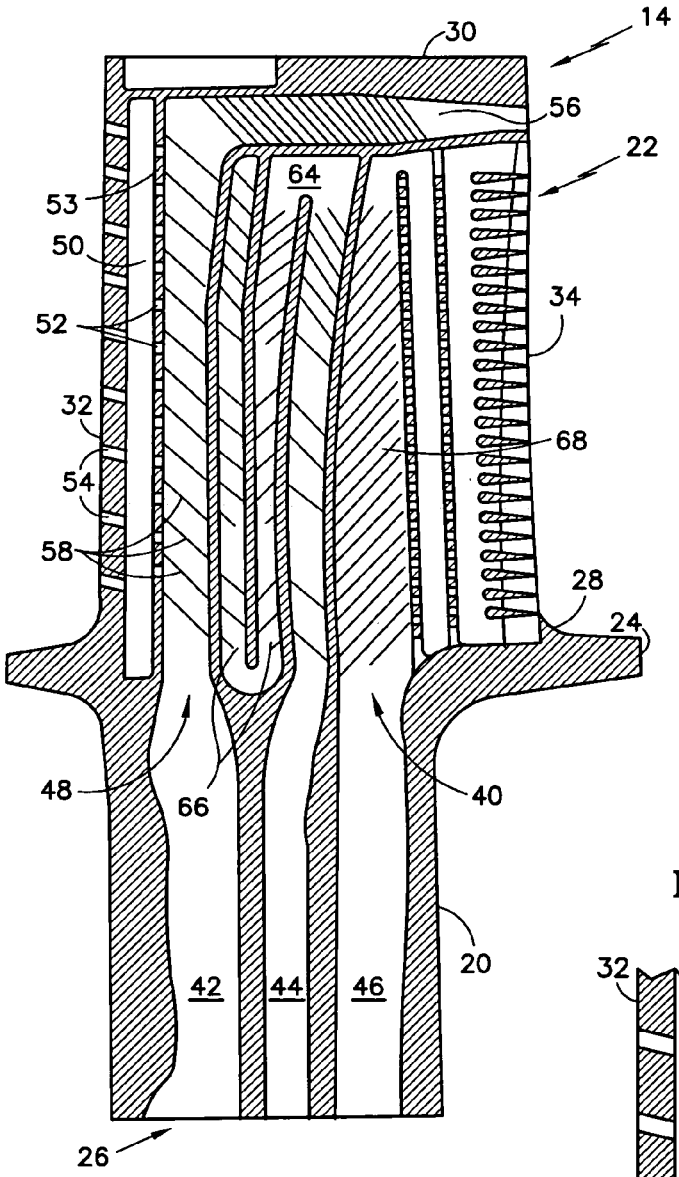
FIG. 2 is a diagrammatic sectional view of a rotor blade having an embodiment of the internal passage configuration.

Referring to FIG. 1, a rotor blade assembly 10 for a gas turbine engine is provided having a disk 12 and a plurality of rotor blades 14. The disk 12 includes a plurality of recesses 16 circumferentially disposed around the disk 12 and a rotational centerline 18 about which the disk 12 may rotate. Each blade 14 includes a root 20, an airfoil 22, a platform 24, and a radial centerline 25. The root 20 includes a geometry (e.g., a fir tree configuration) that mates with that of one of the recesses 16 within the disk 12. As can be seen in FIG. 2, the root 20 further includes conduits 26 through which cooling air may enter the root 20 and pass through into the airfoil 22.

Figure 3:
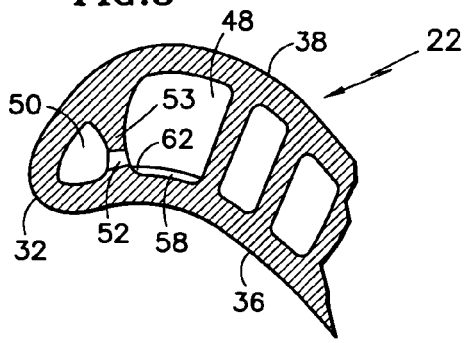
FIG. 3 is a diagrammatic sectional view of a portion of an airfoil cut across a radial plane.
Figure 4:
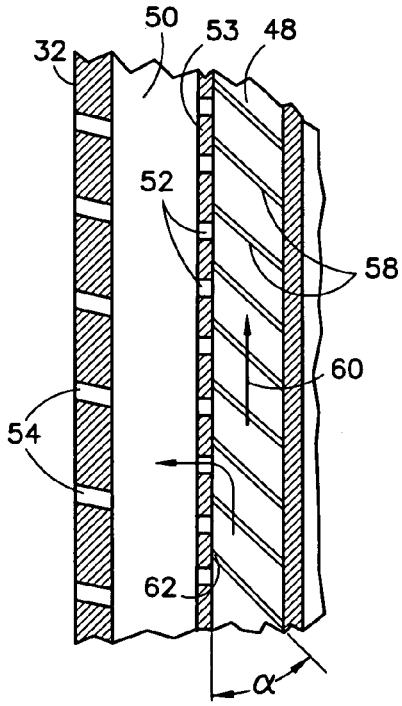
FIG. 4 is a diagrammatic sectional view of a portion of a rotor blade having an embodiment of the internal passage configuration.

Referring to FIGS. 2 and 4, the airfoil 22 includes a base 28, a tip 30, a leading edge 32, a trailing edge 34, a pressure side wall 36 (see FIGS. 1 and 3), and a suction side wall 38, and an internal passage configuration 40. FIG. 2 diagrammatically illustrates an airfoil 22 sectioned between the leading edge 32 and the trailing edge 34. The pressure side wall 36 and the suction side wall 38 extend between the base 28 and the tip 30 and meet at the leading edge 32 and the trailing edge 34.

The internal passage configuration includes a first conduit 42, a second conduit 44, and a third conduit 46 extending through the root 20 into the airfoil 22. Fewer or more conduits may be used alternatively. The first conduit 42 is in fluid communication with a first radial passage 48. A second radial passage 50 is disposed forward of the first radial passage 48, contiguous with the leading edge 32, and is connected to the first radial passage 48 by a plurality of crossover apertures 52. The crossover apertures 52 are disposed in a rib 53 that extends between and separates the first radial passage 48 and the second radial passage 50. The second radial passage 50 is connected to the exterior of the airfoil 22 by a plurality of cooling apertures 54 disposed along the leading edge 32. In some embodiments, the second radial passage 50 comprises one or more cavities. In other embodiments, the second radial passage 50 may be in direct fluid communication with the first conduit 42. At the outer radial end of the first radial passage 48 (i.e., the end of the first radial passage 48 opposite the first conduit 42), the first radial passage 48 is connected to an axially extending passage 56 that extends to the trailing edge 34 of the airfoil 22, adjacent the tip 30 of the airfoil 22.

The first radial passage 48 includes a plurality of trip strips 58 attached to the interior surface of one or both of the pressure side wall 36 and the suction side wall 38. The trip strips 58 are disposed within the passage 48 at an angle $\alpha$ that is skewed relative to the cooling airflow direction 60 within passage 48; i.e., at an angle between perpendicular and parallel to the airflow direction 60. Preferably, the trip strips 58 are oriented at angle of approximately 45° to the airflow direction 60. The orientation of each trip strip 58 within the passage 48 is such that the trip strip 58 converges toward the rib 53 containing the crossover apertures 52, when viewed in the airflow direction 60. Each of the trip strips 58 has an end 62 disposed adjacent the rib 53 (i.e., a "rib end"). At least a portion of the trip strips 58 have a rib end 62 radially located between a pair of crossover apertures 52, preferably approximately midway between the pair of crossover apertures 52. In a preferred embodiment, a majority of the trip strips 58 have a rib end 62 located radially between a pair of crossover apertures 52.

Referring to FIG. 3, in some applications, the crossover apertures 52 disposed in the rib 53 are located closer to one of the pressure side wall 36 or the suction side wall 38. For example, the crossover apertures 52 may be shifted toward the pressure side wall 36 to take advantage of rotational forces acting on the cooling airflow within the passage 48. Alternatively, it may be desirable to shift the crossover apertures 52 to shift the location of the impingement cooling created by the crossover apertures 52. In any case, in these applications the above-described trip strips 58 may be attached to the interior of the wall 36,38 that the crossover apertures 52 are shifted toward. In a preferred embodiment of these applications, substantially all of the trip strips 58 (attached to the wall 36, 38 that the crossover apertures 52 are shifted toward) have a rib end 62 located radially between a pair of crossover apertures 52.

An advantage of the above-described trip strip positioning is that the trip strips 58 provide two functions. First, the trip strips 58 perform a heat transfer function by causing desirable boundary layer conditions within the cooling airflow passing within the passage 48, and by providing additional surface area. Second, the trip strips 58 and their orientation relative to the crossover apertures 52 enable them to function as turning vanes, directing a portion of the cooling airflow toward the crossover apertures 52. As a result, the cooling air passing through the crossover apertures 52 is turning less than the 90° typical in the prior art. Indeed, in the preferred embodiment the 45° oriented trip strips 58 enable the cooling airflow to enter the crossover apertures 52 at an angle of approximately 45°. As a result, the pressure force driving the cooling airflow through the crossover apertures 52 includes a static pressure component and a dynamic pressure component, and the pressure drop across the rib is less than it would be in the aforesaid prior art configurations. The decreased pressure drop allows for a desirable higher backflow margin across the leading edge 32 of the airfoil 22.

Referring to FIG. 2, the second conduit 44 is in fluid communication with a serpentine passage 64 disposed immediately aft of the first and second radial passages 48,50 in the mid-body region of the airfoil 22. The serpentine passage 64 has an odd number of radial segments 66, which number is greater than one; e.g., 3, 5, etc. The odd number of radial segments 66 ensures that the last radial segment in the serpentine 64 ends adjacent the axially extending passage 56. Passage configurations other than the aforesaid serpentine passage 64 may be used within the mid-body region alternatively.

The third conduit 46 is in fluid communication with one or more passages 68 disposed between the serpentine passage 64 and the trailing edge 34 of the airfoil 22.

In the operation of the invention, the rotor blade airfoil 22 is disposed within the core gas path of the turbine engine. The airfoil 22 is subject to high temperature core gas passing by the airfoil 22. Cooling air, that is substantially lower in temperature than the core gas, is fed into the airfoil 22 through the conduits 42,44,46 disposed in the root 20.

Cooling air traveling through the first conduit 42 passes directly into the first radial passage 48, and subsequently into the axially extending passage 56 adjacent the tip 30 of the airfoil 22. A portion of the cooling air traveling within the first radial passage 48 encounters the trip strips 58 disposed within the passage 48. The trip strips 58 converging toward the rib 53 direct the portion of cooling airflow toward the rib 53. The position of the trip strips 58 relative to the crossover apertures 52 are such that the portion of cooling airflow directed toward the rib 53 is also directed toward the crossover apertures 52. The portion of cooling airflow travels through the crossover apertures 52 and into the second radial passage 50. The cooling air subsequently exits the second radial passage 50 via the cooling apertures 52 disposed in the leading edge 32 and the radial end of the second radial passage 48.

Although this invention has been shown and described with respect to the detailed embodiments thereof, it will be understood by those skilled in the art that various changes in form and detail thereof may be made without departing from the spirit and the scope of the invention.

What is claimed is:

1. A rotor blade, comprising:

a root;

a hollow airfoil having a cavity defined by a suction side wall, a pressure side wall, a leading edge, a trailing edge, a base, and a tip;

an internal passage configuration disposed within the cavity, which configuration includes a first radial passage, a second radial passage, a rib disposed between and separating the first radial passage and second radial passage, a plurality of crossover apertures disposed within the rib, and a plurality of trip strips disposed within the first radial passage, attached to an interior surface of one or both of the pressure side wall and the suction side wall, wherein the plurality of trip strips are disposed within the first radial passage at an angle α that is skewed relative to a cooling airflow direction within the first radial passage, and positioned such that each of the plurality of trip strips converges toward the rib, and a rib end of at least a portion of the plurality of trip strips is located approximately midway between a pair of adjacent crossover apertures, a conduit disposed within the root that is operable to permit airflow through the root and into the first passage; and wherein the crossover apertures are located within the rib closer so the pressure side wall than the suction side wall.

2. The rotor blade of claim 1, wherein at least a portion of the plurality of trip strips are attached to the interior surface of the pressure side wall.

3. The rotor blade of claim 2, wherein a rib end of each of the at least a portion of the plurality of trip strips attached to the interior surface of the pressure side wall interior surface of the pressure side wall is located radially between a pair of crossover apertures.

4. The rotor blade of claim 1, wherein the crossover apertures are located within the rib closer to that the suction side wall than the pressure side wall.

5. The rotor blade of claim 4, wherein the plurality of trip strips are attached to the interior surface of the suction side wall.

6. The rotor blade of claim 5, wherein a rib end of each of the at least a portion of the plurality of trip strips attached to the interior surface of the pressure side wall interior surface of the pressure side wall is located radially between a pair of crossover apertures.

7. A rotor blade, comprising:

a root;

a hollow airfoil having a cavity defined by a suction side wall, a pressure side wall, a leading edge, a trailing edge, a base, and a tip;

an internal passage configuration disposed within the cavity, which configuration includes a first radial passage, a second radial passage, a rib disposed between and separating the first radial passage and second radial passage, a plurality of crossover apertures disposed within the rib, and a plurality of trip strips disposed within the first radial passage, attached to an interior surface of the pressure side wall, wherein the plurality of trip strips are disposed within the first radial passage at an angle α that is skewed relative to a cooling airflow direction within the first radial passage, and positioned such that each of the plurality of trip strips converges toward the rib, and a rib end of a majority of the plurality of trip strips is located approximately midway between a pair of adjacent crossover apertures, a conduit disposed within the root that is operable to permit airflow through the root and into the first passage; and wherein the second radial passage is contiguous with the leading edge and the crossover apertures are located within the rib closer to that the pressure side wall than the suction side wall.

8. The rotor blade of 7, wherein the rib end of all of the plurality of trip strips is located between a pair of adjacent crossover apertures.

9. A rotor blade, comprising:

a root;

a hollow airfoil having a cavity defined by a suction side wall, a pressure side wall, a leading edge, a trailing edge, a base, and a tip;

an internal passage configuration disposed within the cavity, which configuration includes a first radial passage, a second radial passage, a rib disposed between and separating the first radial passage and second radial passage, a plurality of crossover apertures disposed within the rib, and a plurality of trip strips disposed within the first radial passage, attached to an interior surface of the suction side wall, wherein the plurality of trip strips are disposed within the first radial passage at an angle α that is skewed relative to a cooling airflow direction within the first radial passage, and positioned such that each of the plurality of trip strips converges toward the rib, and a rib end of a majority of the plurality of trip strips is located approximately midway between a pair of adjacent crossover apertures, a conduit disposed within the root that is operable to permit airflow through the root and into the first passage; and wherein the second radial passage is contiguous with the leading edge and the crossover apertures are located within the rib closer to that the suction side wall than the pressure side wall.

10. The rotor blade of 9, wherein the rib end of all of the plurality of trip strips is located between a pair of adjacent crossover apertures.

* * * * *